US008736199B2

(12) United States Patent
Madey

(10) Patent No.: US 8,736,199 B2
(45) Date of Patent: May 27, 2014

(54) TEMPERATURE STABILIZED MICROWAVE ELECTRON GUN

(76) Inventor: John M. J. Madey, Honolulu, HI (US)

( * ) Notice: Subject to any disclaimer, the term of this patent is extended or adjusted under 35 U.S.C. 154(b) by 255 days.

(21) Appl. No.: 13/085,260

(22) Filed: Apr. 12, 2011

(65) Prior Publication Data

US 2011/0248651 A1 Oct. 13, 2011

Related U.S. Application Data

(60) Provisional application No. 61/323,827, filed on Apr. 13, 2010.

(51) Int. Cl.
*H05H 7/00* (2006.01)

(52) U.S. Cl.
USPC ..... 315/507; 250/423; 376/100

(58) Field of Classification Search
USPC ..... 315/507
See application file for complete search history.

(56) References Cited

U.S. PATENT DOCUMENTS 3,489,944 A 1/1970 Denholm et al.
4,189,656 A 2/1980 Biricik et al.
4,641,103 A * 2/1987 Madey et al. ..... 315/507
4,715,038 A 12/1987 Fraser et al.
5,097,178 A * 3/1992 Nishihara ..... 315/111.81
5,401,973 A 3/1995 McKeown et al.
5,451,794 A * 9/1995 McKeown et al. ..... 250/492.3
2007/0014392 A1 1/2007 Madey et al.

FOREIGN PATENT DOCUMENTS

JP 09-063468 * 8/1995 ..... H01J 1/34
JP 09-063468 A 3/1997
WO WO 2011/130408 A1 10/2011

OTHER PUBLICATIONS

International Search Report and Written Opinion for PCT Patent Application No. PCT/US2011/032321 mailed on Jul. 5, 2011, 11 pages.

* cited by examiner

*Primary Examiner* — Alexander H Taningco
*Assistant Examiner* — David Lotter
(74) *Attorney, Agent, or Firm* — Kilpatrick Townsend & Stockton LLP

(57) ABSTRACT

The temperature rise due to the backstreaming electrons is canceled by an equal and opposite fall in temperature at the surface of the cathode due to the conduction of heat deposited at the surface immediately prior to the microwave pulse by a pulsed laser focused to uniformly illuminate the cathode surface. Variations in temperature across the surface of the cathode attributable to the non-uniform spatial distribution of the backstreaming electrons may be compensated using a second laser pulse fired during the RF pulse to maintain constant thermal power input across the surface of the cathode during the RF pulse. This second pulse can also be used to compensate for the time-dependent rate of decay of temperature due to conduction of the heat deposited by the first laser into the body of the cathode.

13 Claims, 2 Drawing Sheets

TEMPERATURE STABILIZED MICROWAVE ELECTRON GUN

CROSS-REFERENCES TO RELATED APPLICATIONS

This application claims priority to U.S. Provisional Patent Application No. 61/323,827, filed Apr. 13, 2010, entitled "Temperature Stabilized Microwave Electron Gun," the entire disclosure of which is incorporated by reference herein for all purposes.

BACKGROUND OF THE INVENTION

The microwave electron gun, first described in U.S. Pat. No. 4,641,103, has proven to be a highly effective source of electrons for applications requiring high peak current and high beam quality such as free electron lasers and accelerators for particle physics research. Broadly, such a gun subjects the electrons emitted from a cathode to an intense microwave electric field for acceleration, and then typically blocks all but a narrow range of momentum to provide the bunching required by the linear accelerator. The gun comprises a resonant microwave cavity and a cathode mounted in the cavity wall.

The resonant microwave cavity, when supplied with microwave power, supports an electromagnetic field having a high-gradient electric component directed along an acceleration axis. The cavity is formed with an exit aperture at a location relative to the cathode such that emitted electrons are accelerated along the axis and pass through the exit aperture. Bunching, if required, is provided by a momentum analyzer system, which may include a dispersive magnet and a slit. An electron emerging from the cavity has an energy (energy and momentum have a one-to-one relationship, and thus will sometimes be used interchangeably) determined by the phase of the microwave field at the time of that electron's emission. The magnet causes electrons with different energies to follow different trajectories, while the slit is disposed to block those electrons having energies outside a desired narrow range of energies and phases. Thus, only those electrons having energies corresponding to a narrow range of phases are permitted to pass through the momentum analyzer, thereby forming a pre-bunched electron beam for injection into a linear accelerator.

However, use of the technology has been complicated by the back-heating phenomenon, in which electrons emitted from the cathode late in the accelerating phase of the applied microwave field are decelerated by the field before they escape the cavity, and are returned to the cathode with sufficient energy to raise the cathode temperature (and hence the emitted current density) as time progresses during the pulse. While the phenomenon has little impact on operation for modest emitted currents and short RF pulses, the temperature rise for higher cathode currents and/or longer pulses can substantially alter the beam current during the pulse, causing the energy of the electrons leaving the cavity to droop due to beam loading. In the worst case, this can lead to thermal runaway in which the cathode temperature rises uncontrollably due to ever-increasing back-heating. These electrons are referred to as backstreaming electrons.

Efforts to eliminate back-heating have included application of a transverse magnetic field to deflect the backstreaming electrons so that they strike the walls of the cavity surrounding the cathode instead of the cathode, and optimization of the dimensions and configuration of the cavity to reduce the chances that the electrons emitted late in the accelerating phase of the field will be returned to the cathode. An attempt has also been made to use ring-shaped or toroidal cathodes to exploit the tendency of the back-heating electrons in these designs to return to the cathode near the axis where they would strike a non-emissive component of the cathode assembly. None of these approaches has succeeded in reducing the temperature rise of the cathode to the level in which cathode emission remains substantially constant during the pulse.

SUMMARY OF THE INVENTION

In embodiments of the present invention, the temperature rise due to the backstreaming electrons is canceled by an equal and opposite fall in temperature at the surface of the cathode due to the conduction of heat deposited at the surface immediately prior to the microwave pulse by a pulsed laser focused to uniformly illuminate the cathode surface. Variations in temperature across the surface of the cathode attributable to the non-uniform spatial distribution of the backstreaming electrons may be compensated using a second laser pulse fired during the RF pulse to maintain constant thermal power input across the surface of the cathode during the RF pulse. This second pulse can also be used to compensate for the time-dependent rate of decay of temperature due to conduction of the heat deposited by the first laser into the body of the cathode.

Although U.S. Pat. No. 4,641,103 included a description of the use of a pulsed ultraviolet laser to enhance or control emission from the cathode of a microwave gun, or to reduce the cathode temperature required for operation of the gun, the laser described in U.S. Pat. No. 4,641,103 served to increase electron emission, not to reduce the temperature of the cathode during emission. And while the literature also includes a description of a microwave gun in which a laser is used to heat the cathode, that application describes the use of a continuous laser applied to the rear surface of the cathode and therefore intrinsically unable to achieve the temperature control described in this invention.

Accordingly, the invention described herein is novel, and can substantially improve the operation of the microwave electron guns described in the prior art.

A representative embodiment of the invention includes:

1. a pulsed microwave electron gun such as the one described in U.S. Pat. No. 4,641,103,
2. a first pulsed illuminating laser (pre-pulse laser) timed to produce a temperature pulse at the surface of the cathode whose rate of decay with time is at least equal to the rate of rise of cathode temperature due to electron backstreaming,
3. a second pulsed illuminating laser (optional auxiliary laser) whose temporal and spatial profile are adjusted to keep the cathode surface temperature constant during the microwave pulse, and
4. an auxiliary heater to make up the heat losses due to conduction and black body radiation required to stabilize the cathode against thermal runaway.

As a possible alternative embodiment of the invention, the spatial profile of the second illuminating laser can be modified to achieve cathode current spatial profiles matched to specific applications by controlling the spatial profile of the cathode surface temperature.

As a second possible embodiment of the invention, the second pulsed illuminating laser can be eliminated in the interests of simplicity, reliability and reduced cost at the expense of less perfect regulation of the cathode surface temperature.

A further understanding of the nature and advantages of the present invention may be realized by reference to the remaining portions of the specification and the drawings.

DESCRIPTION OF SPECIFIC EMBODIMENTS

Overview

Figure 1:
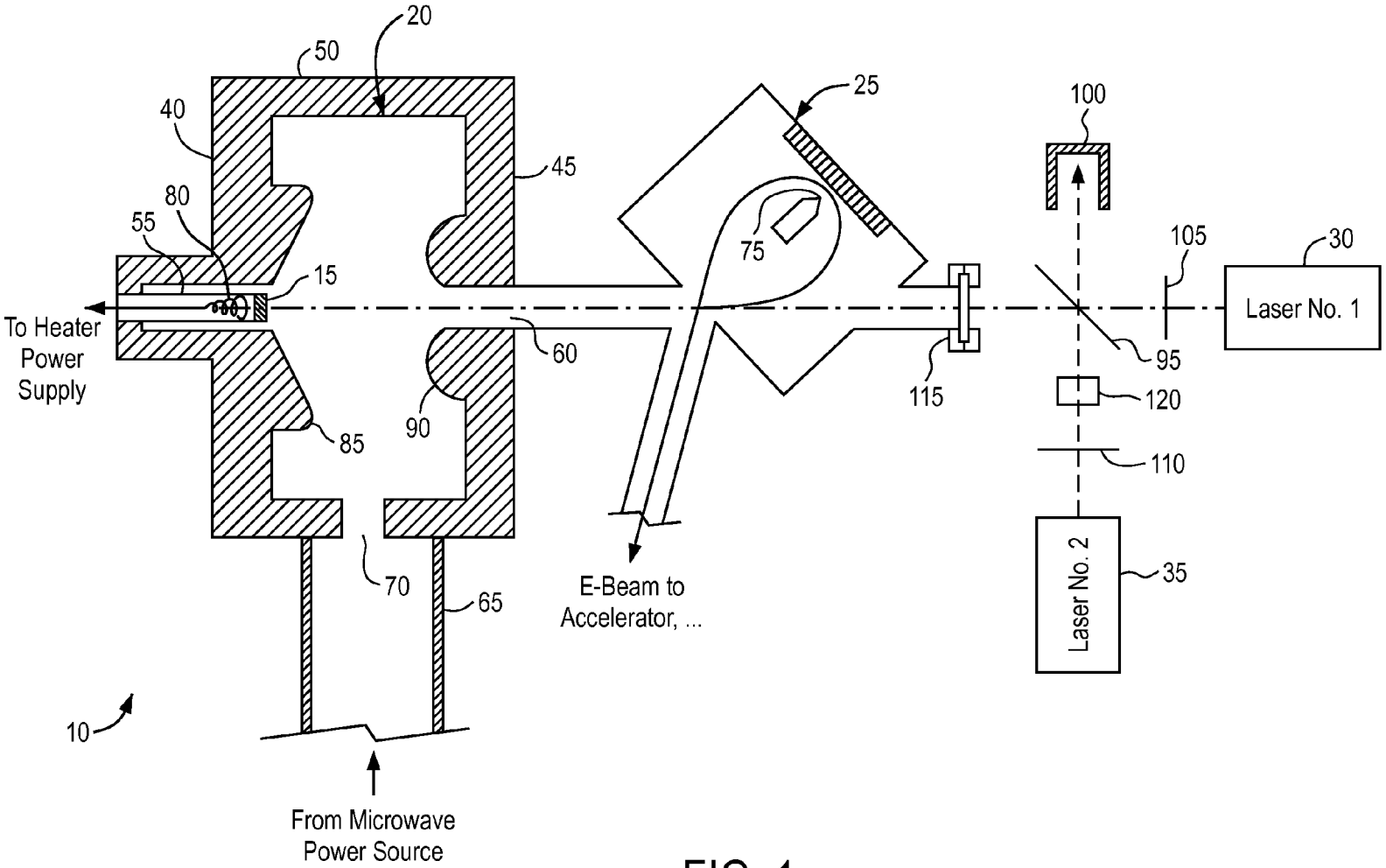
FIG. 1 is a microwave electron gun according to an embodiment of the present invention.

FIG. 1 is a microwave electron gun 10 according to an embodiment of the present invention. Such a microwave gun is suitable for use with a linear accelerator, often referred to as a linac (not shown), and at least some of the discussion will concentrate on that application. The microwave gun includes structure along the lines of U.S. Pat. No. 4,641,103, the disclosure of which is incorporated by reference. As will be described in detail below, the prior art microwave gun is modified to address and overcome problems of overheating caused by backstreaming electrons.

In broad terms, the microwave gun comprises a cathode 15, a resonant microwave cavity 20, a momentum analyzer (momentum filter) 25, and a first laser 30, also referred to as the pre-pulse laser. Some embodiments include a second laser 35, also referred to as the auxiliary laser. Pre-pulse laser 30 and optional auxiliary laser 35 are the additional components that address the backstreaming electron problem. Although a thermionic cathode is used in specific embodiments, other cathodes (e.g., photoemissive cathodes, or laser-assisted thermionic cathodes, or field-emission cathodes) where the current density depends on the temperature of the emitting surface can be used.

Other possible applications that could benefit from use of the invention include radiotherapy linacs that can operate with a broader energy spread and hence do not need the momentum analyzer, or guns using photocathodes in which the illuminating laser pulse is sufficiently short as to limit the bunch length and energy spread without the use of the momentum filter.

Cavity 20 is cylindrical, having opposed end walls 40 and 45, and a peripheral side wall 50. Cathode 15 is mounted generally centrally along end wall 40 on a supporting structure 55, and end wall 45 is formed with a central exit aperture 60 in communication with the beam transport to momentum analyzer 25. A waveguide 65 communicates with the cavity interior through an inlet port 70, and couples to a source of microwave power (not shown). Momentum analyzer 25 includes a magnet (not shown) and a momentum analyzing slit 75 located within an evacuated chamber in the magnetic field region. An auxiliary heater 80 provides heat to the back surface of cathode 15, and cooperates with pre-pulse laser 30 and auxiliary laser 35 as will be described below. The auxiliary heater can be an incandescent filament or a laser.

In operation, cathode 15 is heated, and microwave power is supplied to the gun as microwave pulses. The microwave pulses are typically of a few microseconds in duration at intervals of several or tens of milliseconds, with the microwave frequency normally in the range of 1-10 GHz (wavelength in the range of 3-30 cm). Cathode 15 emits electrons, which are accelerated by the microwave field in cavity 20, pass through exit aperture 60, and enter momentum analyzer 25. Those electrons having energies in a particular energy range exit the momentum analyzer for their intended use. It is noted that the present invention does not require the use of a momentum analyzer for those applications, such as those outlined above, where a narrow range of electron energies is not needed.

In a representative embodiment, the magnet in momentum analyzer 25 is configured to cause an electron entering the momentum analyzer to undergo approximately 270° of deflection prior to exiting the momentum analyzer. Electrons of different energies are dispersed laterally, and momentum analyzing slit 75 allows electrons within a particular range to pass while blocking electrons outside the range.

While the particulars of the cavity structure are not part of the invention, it is noted that end wall 40 carries an inwardly extending nosepiece 85 surrounding cathode 15 and end wall 45 carries an inwardly extending, toroidal nosepiece 90 surrounding exit aperture 60. Nosepiece 85 is shaped to define a generally frustoconical surface surrounding cathode 15, and serves to shape the electric field surrounding cathode 15 in a manner that minimizes the space-charge induced emittance growth of the electrons that are emitted from the cathode. Nosepiece 85 and nosepiece 90 also have the effect of increasing the electric field to which the electrons are subjected.

According to a further optional refinement, supporting structure 55 positions cathode 15 at a location along cavity wall 40 in a manner that provides thermal isolation while maintaining cathode 15 at the same RF voltage as the cavity wall. To accomplish this, end wall 40 carries a half-wavelength coaxial transmission line ("stub") extending axially outward from a first (cavity) end at the cavity wall to a second (termination) end at which the stub is shorted. Cathode 15 is physically located at the cavity end, but the mounting is at the termination end.

Overview of Structure and Operation of Pre-Pulse Laser 30 and Auxiliary Laser 35

Pre-pulse laser 30 and auxiliary laser 35 perform separate functions, and as alluded to above, auxiliary laser 35 is not needed in all embodiments. However, the description that follows will describe an embodiment with the two lasers. Pulsed beams from the two lasers are directed to the front face of cathode 15. The beams are directed along separate paths and encounter a beamsplitter 95. In the particular geometry shown, the transmitted component of pre-pulse laser 30's beam and the reflected component of auxiliary laser 35's beam are directed to the cathode. The reflected component of pre-pulse laser 30's beam and the transmitted component of auxiliary laser 35's beam are directed to a beam dump 100. The beams from pre-pulse laser 30 and auxiliary laser 35 are directed through respective shaping screens 105 and 110. An optical window 115 allows the beams to pass into the evacuated gun.

Figure 2:
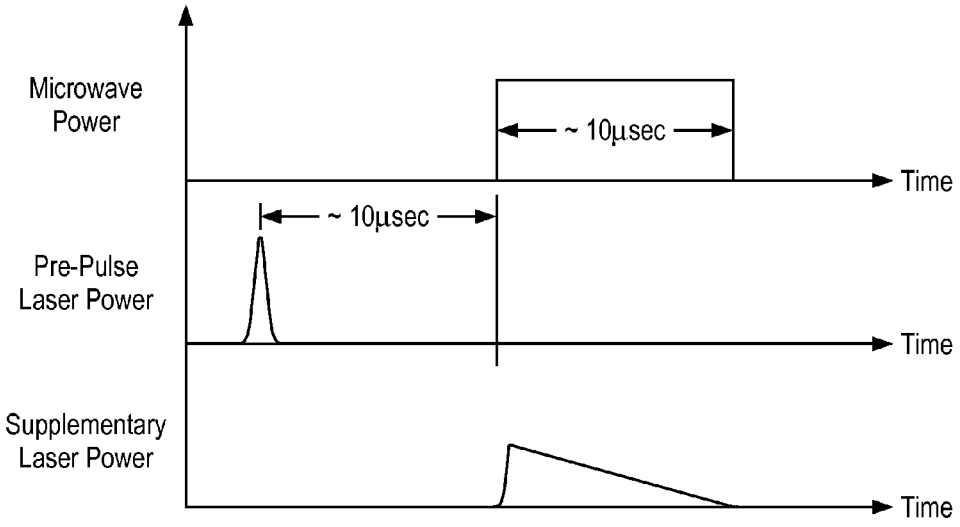
FIG. 2 is a schematic timing diagram showing the relationship of the two laser pulses and the applied RF pulse.

FIG. 2 is a schematic timing diagram showing the relationship of the two laser pulses and the applied RF pulse. In short, pre-pulse laser 30 operates to provide a thermal pulse at the cathode surface just before the microwave pulse, and auxiliary laser 35 operates to compensate for the temperature variations as a result of the decaying thermal pulse and the heating by the backstreaming electrons. It is sometimes convenient to refer to the pulses from pre-pulse laser 30 and auxiliary laser 35 as the first and second laser pulses.

As can be seen in FIG. 2, pre-pulse laser 30's beam is fired just prior to the application of microwave power to the gun to produce a thermal pulse at the surface of cathode 15. The cathode thus reaches its peak temperature before the application of microwave power, and has a decreasing temperature during the microwave pulse as the thermal energy deposited by pre-pulse laser 30 is transported by conduction into the body of the cathode. This pulse is generally one or two orders of magnitude shorter in duration than the microwave pulse, say on the order of 100 nanoseconds, or even shorter, say on the order of 10 nanoseconds, compared to a microwave pulse duration of 5-100 microseconds. A longer laser pulse duration for pre-pulse laser 30, say up to a microsecond could have the advantage of delivering the desired amount of energy with a lower peak power. Currently, however, most practical pulsed lasers have pulses significantly shorter than a microsecond.

Pre-pulse laser 30 can have any wavelength, so long as the cathode surface has adequate emissivity (say >0.5) at that wavelength. A pulsed, solid state infrared laser with a pulse length on the order of 0.1-1.0 microseconds and a pulse energy on the order of 0.01-1.0 joules, could provide the thermal input needed for operation of microwave guns with average current outputs on the order of 100-1000 milliamps. Shaping screen 105's purpose is to shape and focus the beam as required to uniformly illuminate the surface of the cathode during the pulse. The particular form of shaping screen 105 is typically derived from thermal scans of the cathode surface taken under the conditions in which the cathode will be operated.

As can also be seen in FIG. 2, auxiliary laser 35's beam is timed to fire during the application of microwave power, and is generally commensurate in duration with the microwave pulse. This beam is shaped and modulated to compensate for (a) the non-linear variation of temperature with time following the application of the first laser pulse, and (b) the specific temporal and spatial distribution of the temperature rise attributable to the backstreaming electrons, thereby maintaining the cathode surface at a constant temperature.

Auxiliary laser 35 should have a photon energy below the value needed to induce photoemission, as this laser is intended only to facilitate local control of the cathode temperature, and not to contribute to emission. Auxiliary laser 35 should have a pulse length equal to the length of the applied microwave pulse, and can have a pulse energy on the order of 0.1-1.0 joules. Screen 110 shapes the laser beam as required to control the optical power density as a function of position on the surface of the cathode.

Since both laser beams are pulsed beams, suitable mechanisms are provided to modulate the respective laser beams as required to control the optical power density on the front surface of cathode 15 as a function of time. In a representative embodiment, auxiliary laser 35 is provided with a separate modulator 120, which may be a Pockels cell. While the two laser pulses may be of generally commensurate energy, pre-pulse laser 30's pulse is much shorter, and therefore has a much higher peak power than auxiliary laser 35's pulse. Therefore, the energy of the pre-pulse laser is preferably controlled by changing the timing of its Q-switch or the voltage of its flash lamps.

Auxiliary heater 80 provides heat to the rear surface of the cathode to provide the steady state thermal input required to maintain the cathode at the desired operating temperature. In a typical embodiment, auxiliary heater 80 would provide on the order of 20-50% of the total power required to maintain cathode temperature. In some instances, the auxiliary heater can be dispensed with. For example, if 100 millijoule pulses are delivered at 100 Hz, this amounts to an average power of 10 watts, which may be sufficient to maintain the cathode temperature without the auxiliary heater.

Thermal Modeling and Additional Design Considerations

As described below, the invention exploits the linearity of the thermal diffusion equation and the characteristic dependence of surface temperature on time during and after illumination of the cathode surface to achieve a transient equilibrium state in which the increase in temperature at the cathode surface due to the backstreaming electrons and the power deposited by the second laser is balanced by the decay in surface temperature following illumination by the first pulsed laser.

Figure 3:
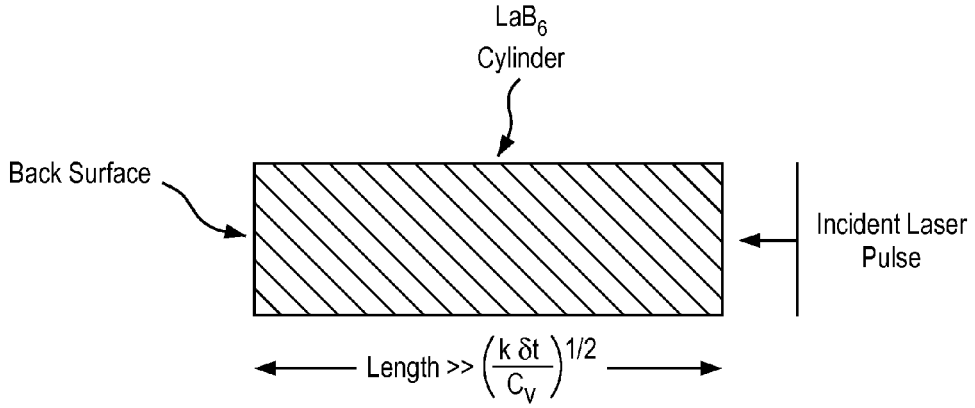
FIG. 3 is a schematic of a cylindrical cathode suitable for modeling the processes.

For descriptive purposes it suffices to model cathode 15 as an opaque, uniform right circular cylinder as shown in FIG. 3 with a diameter equal to the active diameter of the cathode, a length large in comparison with the scale length for thermal diffusion on the time scale defined by the length of the first incident laser pulse and the length of the electron pulse subsequently emitted by the cathode. Power is coupled to and from the cylindrical cathode in this model by means of:

a. the illumination of the front surface by the first pulsed laser,
b. the power deposited in the bulk of the cathode behind the surface by the high energy backstreaming electrons,
c. the illumination of the front surface by the second pulsed laser,
d. the power coupled to the back surface of the cylinder by the auxiliary heater,
e. emission of black body radiation, and
f. conduction of heat from the back surface of the cathode through the means used to support the cathode.

The response of the cathode, particularly the front surface of the cathode, can be modeled using Fourier's equation:

$$C_v \cdot dT(r,t)/dt = -k \cdot \nabla^2 T(r,t) \quad (1)$$

Where:

T (r, t) is the temperature as a function of time t and position r, $C_v$ is the specific heat per unit volume, k is the thermal conductivity, and $\nabla^2$ is the Laplacian differential operator.

For the case in which the front surface of the cathode is uniformly illuminated by the first laser and radiation losses can be neglected, only the temperature variation along the axis of the cylinder needs to be considered, and only the one-dimensional form of Fourier's equation needs to be considered:

$$C_v \cdot dT(r,t)/dt = -k \cdot d^2 T(r,t)/dz^2 \quad (2)$$

For both the general three-dimensional case and the special one-dimensional case, Fourier's equation is linear in the temperature T (r, t), so that the general solution corresponding to the sum of all power sources and sinks and defined boundary conditions is equal, simply, to the sum of the individual solutions for each source.

In this model, the primary effect of the first laser pulse is to deliver a pulse of thermal energy equal to the product of the emissivity and optical energy of the pulse to the surface of the cathode at a rate equal to the product of the emissivity and the instantaneous power of the light pulse. The thermal energy deposited by such an optical pulse is confined to a surface layer of thickness approximately equal to $\delta z \sim (k \cdot \delta t / C_v)^{1/2}$ where $\delta t$ is the length of the optical pulse. For short light pulses and temperatures for which the power emitted from the surface as black body radiation can be neglected, the surface temperature increases approximately as the square root of the elapsed time, ending at a peak temperature equal approximately to the ratio of the deposited energy to the specific heat of the material contained in this surface layer.

At the termination of the laser pulse, the surface temperature begins to fall, decaying with time as the inverse square root of the time elapsed since the beginning of the pulse as the thermal energy deposited at the surface diffuses into the volume beneath the surface.

In further detail, the thermal power emitted as black body radiation can generally be neglected for laser pulses on the order of a microsecond in length and operating temperatures characteristic of the operation of dispenser and lanthanum hexaboride cathodes (1100-1400 degrees C.) in current microwave electron guns. From the solution of the one-dimensional Fourier equation for heat conduction, the rise in temperature $\delta T(t_0)$ at the surface of the cathode due to the deposition of a pulse of thermal energy Q in the time interval $0-t_0$ can therefore be approximated by:

$$\delta T(t_0) \sim (Q/A)/(4 \cdot \mathrm{sqrt}(\pi \cdot C_v \cdot k \cdot t_0)) \quad (3)$$

Where:

Q/A is the heat input per unit area, $C_v$ is the specific heat per unit volume, and k is the thermal conductivity.

The maximum temperature rise $\delta T_0 = \delta T(t_0)$ occurs just at the end of the illuminating laser pulse. The temperature for times $t > t_0$ decays monotonically with time as $t^{-1/2}$ during the interval following the laser pulse. Although the magnitude of the temperature rise in this model depends on the cathode's thermal conductivity and specific heat as well as the thermal energy deposited by the illuminating laser, the rate of decay of temperature for a fixed temperature rise $\delta T_0 = \delta T(t_0)$ is independent of these variables, varying with time as:

$$d(\delta T)/dt = -\delta T(t)/2t \quad (4)$$

$$= -\delta T(t_0)/2t^{3/2}$$

It follows that the rate of decay of temperature with time is greatest for times $t \sim t_0$, decaying monotonically to zero for $t >> t_0$.

Therefore, within the limits set by the available laser pulse energy and cathode emissivity, thermal conductivity and specific heat, the laser pulse energy and trigger time can be chosen to yield a rate of decay of temperature with time at the cathode surface equal, but opposite to the rate of increase in temperature with time at the beginning of the onset of electron emission, or at any subsequent time within the cathode current pulse.

The operation of the microwave guns described in U.S. Pat. No. 4,641,103 is most typically optimized when the temperature rise of the surface of the cathode is reduced to a minimum during the current pulse emitted by the cathode. Observation of gun operation with lanthanum hexaboride cathodes at 1400 degrees centigrade indicate that the energy deposited at the surface by backstreaming electrons is sufficient to increase the cathode current by nearly a factor of two during a 6-microsecond current pulse. Using the Dushman equation to estimate the increase in temperature required to generate this increase in emission, it can be inferred that the energy deposited by the backstreaming electrons typically heats the surface by the order of 50 degrees centigrade during such a current pulses resulting in a rate of rise of temperature on the order of:

$$(dT/dt)_{backstreaming\ electrons} \sim 50^\circ \text{ K/6 microseconds}$$
$$(\text{i.e., } \sim 8.3 \cdot 10^{6^\circ} \text{ K/second})$$

Assuming a one joule, 1 microsecond laser pulse, 10 $mm^2$ cathode area, and the approximate specific heat and thermal conductivity for lanthanum hexaboride:

Volume Specific Heat~1 cal/($cm^2$·sec·° K)

Thermal Conductivity~$3.5 \cdot 10^{-2}$ cal/(cm·sec·° K)

the rise in temperature at the start of the cathode current pulse can be compensated by triggering the pre-pulse laser to fire 10 microseconds prior to the onset of cathode emission.

Alternatively, since the rate of decay of temperature due to conduction of the initial thermal impulse into the bulk decreases monotonically with time, the timing of the illuminating laser pulse can be adjusted to minimize the variation of surface temperature at other points within the current pulse: for example, that the rise in surface temperature at the end of the pulse could with the same parameters be canceled by triggering the pre-pulse laser 4 microseconds prior to the onset of emission.

Since the rate of surface cooling due to conduction of the heat deposited by such a pulsed laser is not constant, but varies at the −3/2 power of the time since illumination by the laser, the attainment of constant cathode temperature during the current pulse requires that an additional means be provided to heat the surface of the cathode during the pulse at a rate equal to the difference between the rate of cooling due to conduction of the initial thermal pulse into the bulk and the rate of rise of temperature due to the backstreaming electrons. This additional thermal power input can most easily be secured by illuminating the surface of the cathode with a second laser whose power is modulated in time to keep the surface temperature constant. The spatial profile of this second laser beam can also be adjusted as required to maintain a more nearly constant rate of rise of surface temperature across the cross section of the cathode if the distribution of the backstreaming electrons varies with position.

It is seen from this description that the increase in surface temperature due to the backstreaming electrons in a pulsed microwave electron gun can be compensated by supplying part of the energy required to heat the cathode to operating temperature via a pulse of laser light triggered to illuminate the surface of the cathode in advance of the cathode current pulse and timed to yield a rate of surface cooling equal to the rate of surface heating due to the backstreaming electrons at the end of the current pulse, and a second laser pulse timed to overlap the cathode current pulse and modulated in time and spatial profile as required to minimize the net change in surface temperature during the current pulse.

The energy and timing of the first laser pulse can be estimated from the rate of rise of the surface of the cathode as deduced from the change in cathode emission during the pulse and the thermal conductivity and specific heat of the cathode material. Beginning with this estimate, the laser pulse energy and timing can be optimized during operation by adjusting these parameters to minimize the change in emission during the current pulse. The intensity of the laser light delivered to the cathode by the second laser can be optimized using a conventional feedback loop as the thermal power deposited at the surface by this second laser acts to increase the surface temperature more or less as the time integral of the power.

The spatial profile of the light delivered to the cathode surface by the second laser can be optimized either by trial and error through observation of the effects of differing spatial distributions on the temporal profile of the cathode current, or by use of a fast, imaging pyrometer to determine those areas of the cathode in which additional thermal input is required to maintain constant temperature.

Since certain applications may benefit from the use of an electron beam with a spatially varying current density, the second laser can also be used to modify the temperature profile on the surface of the cathode, and therefore the spatial profile of the emitted cathode current. The optimum spatial profile of the laser light needed for these applications can be determined either: (1) from a detailed, first principles solution of the equations of motion for the system, the electron optics used to transport the electrons emitted from the cathode to the system in which they will be used, and solution of the three-dimensional form of the Fourier heat transfer equation: (2) by use of a fast imaging pyrometer to visualize the effect of differing spatial laser profiles on cathode temperature; or (3) by empirical observation of the effects of variation of the spatial profile of the second pulsed laser beam on system performance.

Alternatively, it may be that certain applications with which this microwave gun will be used require only coarse stabilization of the temporal and spatial variations in cathode current density during the microwave pulse consistent with the simple $t^{-3/2}$ decay in cathode surface temperature following the firing of the first laser pulse. For these less demanding applications, the second pulsed laser can be dispensed with in the interests of simplicity, reliability and reduced cost.

To avoid thermal runaway, the thermal conductivity of the components used to mount the cathode should be high enough to insure that the thermal energy deposited on the surface of the cathode by the first and second lasers and by the backstreaming electrons cannot heat the cathode to a temperature beyond its rated operating temperature. Provided that the power lost to conduction and black body radiation exceeds the power added by the two lasers and the backstreaming electrons, an auxiliary heater (conventional heater or laser) can be employed to provide a few watts additional power to the rear surface of the cathode to heat the cathode to the temperature required to sustain operation. As with the microwave gun described in U.S. Pat. No. 4,641,103, the power provided by this auxiliary heater can be maintained as part of a closed-loop feedback system to maintain the cathode at constant average temperature, or to maintain the cathode current at its specified operating value.

The typical operating parameters for such a temperature-stabilized microwave electron gun would be as follows:

| | |
|---|---|
| Cathode material | lanthanum hexaboride |
| Total cathode current during pulse | 500 milliamps |
| Cathode current pulse length | 6 microseconds |
| Repetition Rate | 20 Hz |
| Rate of rise of cathode surface temperature due to backstreaming electrons | 50° K/(6 μsec) |
| Energy deposited on cathode surface by pre-pulse laser | 100 millijoules |
| Timing of pre-pulse laser | 10 μsec before microwave power pulse |

Additional Embodiments

While a single microwave cavity is shown and is used in specific embodiments, the invention is not limited to a single cavity. Thus, the notion of a "cavity" includes multi-cell cavities in which the electron beam is accelerated during passage through a sequence of cavities phased to optimize the net acceleration while reducing the probability that an electron will reverse direction and strike the cathode during the RF pulse. The term "cavity" simply specifies a resonant structure in which the active volume is enclosed by conducting boundary conditions which, by design and construction, achieve a high accelerating gradient in operation at the frequency of the RF source, and employ that gradient to accelerate a charged particle beam in some way.

This can include the use of the accelerating field to extract the electrons from the cavity as well as subsequently to accelerate these electrons; there is nothing in this definition of "cavity" which would exclude the use of the term to describe a cavity which consisted of two or more coupled "cells" in which the amplitude and phase of the fields in each cell were set by techniques well known in the art to values appropriate for the acceleration of the electrons emitted from the cathode, and the reduction of the probability that the accelerated electrons would reverse direction and strike the cathode.

Similarly, while a simple cylindrical cathode is shown, cathodes that emit beams with additional possible cross sections can be used. For example, annular electron beams have found a number of important uses in e-beam based sources of electromagnetic radiation, and there is also clearly interest in elliptical beams in which the beam height and width differ.

CONCLUSION

In conclusion it can be seen that the present invention provides elegant and effective techniques for stabilizing the temperature of the cathode in the face of backstreaming electrons.

While the above is a complete description of specific embodiments of the invention, the above description should not be taken as limiting the scope of the invention as defined by the claims.

What is claimed is:

1. An electron gun comprising:

an RF cavity defining an internal volume for supporting an electromagnetic field having an RF electric field component within said volume when microwave power is supplied to said cavity;

a source that supplies microwave power to said cavity during a sequence of intervals referred to as microwave pulse intervals;

a cathode for emitting electrons, said cathode being mounted in said cavity such that electrons emitted from a front surface of said cathode enter said volume and are subjected to said RF electric field component wherein at least some electrons are backstreaming electrons that heat said cathode; and a pulsed illumination laser that illuminates said front surface of said cathode during one or more intervals preceding respective microwave pulse intervals wherein light from said illumination laser produces a thermal pulse at said front surface of the cathode prior to the respective microwave pulse interval, and heat produced by said thermal pulse is conducted away from said front surface of the cathode during the respective microwave pulse interval thereby lowering the temperature at said front surface of said cathode, thereby at least compensating said heat generated by the backstreaming electrons.

2. The electron gun of claim 1 wherein said pulsed illumination laser has a beam that is shaped and focused to substantially uniformly illuminate said front surface of said cathode.

3. The electron gun of claim 1 wherein said thermal pulse has a rate of decay with time that is at least equal to a rate of rise of cathode temperature due to the backstreaming electrons.

4. The electron gun of claim 1, and further comprising an additional pulsed illumination laser that illuminates said front surface of said cathode during respective microwave pulse intervals.

5. The electron gun of claim 4 wherein said additional pulsed illumination laser has temporal and spatial profiles that are adjusted to keep the cathode surface temperature constant during the microwave pulse intervals.

6. The electron gun of claim 4 wherein said additional pulsed illumination laser has temporal and spatial profiles that are adjusted to compensate for (a) non-linear variations of temperature with time following said illumination by said first-mentioned illumination laser, and (b) the specific temporal and spatial distribution of the temperature rise attributable to the backstreaming electrons.

7. The electron gun of claim 1, and further comprising an auxiliary heater that provides additional heat beyond the heat provided by said illumination laser and the backstreaming electrons to make up heat losses due to conduction and black body radiation away from said cathode to stabilize the cathode temperature during the microwave pulse intervals.

8. A method of operating a pulsed microwave electron gun that includes an RF cavity that supports an electromagnetic field having an RF electric field component when microwave power is supplied to the RF cavity, and a cathode that emits electrons that are accelerated by the electric field, the method comprising:

during a first interval, illuminating a front surface the cathode with a pulse of optical energy to produce a thermal pulse at the front surface such that the thermal pulse reaches a peak temperature during the first interval; and during a second interval following the first interval, supplying microwave power to the cavity, wherein during the second interval, heat produced by the thermal pulse during the first interval is conducted away from the front surface of the cathode, electrons emitted from the cathode are subjected to the RF electric field component such that electrons emitted during certain phases of the RF electric field component are accelerated out of the cavity while electrons emitted during other phases of the RF electric field component are accelerated away from the cathode but are then accelerated back toward the cathode so as to hit the front surface of the cathode and heat the cathode, the electrons hitting the front surface of said cathode being referred to as backstreaming electrons, and the conduction of heat away from the front surface of the cathode at least partially compensates the heat generated by the backstreaming electrons.

9. The method of claim 8, and further comprising:

during the second interval, illuminating at least a portion of the front surface of the cathode with an additional pulse of optical energy having a duration commensurate with the second interval.

10. An electron gun comprising:

an RF cavity defining an internal volume for supporting an electromagnetic field having a high-gradient electric component within said volume, said RF cavity having first and second wall portions, said wall portions being separate from each other, said second wall portion being formed with an exit aperture;

a cathode for emitting electrons, said cathode being mounted proximate said first wall portion such that electrons emitted from said cathode enter said volume and are subjected to said electric field component and accelerated thereby so as to pass through said exit aperture;

a pulsed illuminating laser timed to produce a thermal pulse at the surface of the cathode whose rate of decay with time is at least equal to the rate of rise of cathode temperature due to backstreaming electrons; and an auxiliary heater to make up the heat losses due to conduction and black body radiation required to stabilize the cathode against thermal runaway.

11. The electron gun of claim 10, and further comprising an additional pulsed illuminating laser whose temporal and spatial profile are adjusted to keep the cathode surface temperature constant during the microwave pulse.

12. The electron gun of claim 10, and further comprising an additional pulsed illuminating laser whose spatial profile is adjusted to achieve cathode current spatial profiles matched to specific applications by controlling the spatial profile of the cathode surface temperature.

13. An electron gun comprising:

an RF cavity defining an internal volume for supporting an electromagnetic field having an RF electric field component within said volume when microwave power is supplied to said cavity, said cavity having first and second wall portions, said wall portions being separate from each other, said second wall portion being formed with an exit aperture;

a source that supplies microwave power to said cavity during a sequence of intervals referred to as microwave pulse intervals;

a cathode for emitting electrons, said cathode being mounted proximate said first wall portion such that electrons emitted from a front surface of said cathode enter said volume and are subjected to said RF electric field component wherein electrons emitted during certain phases of the RF electric field component are accelerated out of said cavity, electrons emitted during other phases of the RF electric field component are accelerated away from said cathode but are then accelerated back toward said cathode and hit said front surface of said cathode, the electrons hitting said front surface of said cathode being referred to as backstreaming electrons, and the backstreaming electrons heat said cathode; and a pulsed illumination laser that illuminates said front surface of said cathode during one or more intervals preceding respective microwave pulse intervals wherein light from said illumination laser produces a thermal pulse at said front surface of the cathode prior to the respective microwave pulse interval, and heat produced by said thermal pulse is conducted away from said front surface of the cathode during the respective microwave pulse interval thereby lowering the temperature at said front surface of said cathode, thereby at least compensating said heat generated by the backstreaming electrons.

* * * * *